US009938678B2

(12) United States Patent
Lakin et al.

(10) Patent No.: US 9,938,678 B2
(45) Date of Patent: Apr. 10, 2018

(54) PLOW BLADE WEAR MEMBER

(71) Applicant: Lakin General Corporation, Chicago, IL (US)

(72) Inventors: Lewis G. Lakin, Ft. Lauderdale, FL (US); Kenneth A. Lakin, Lake Forest, IL (US)

(73) Assignee: Lakin General Corporation, Chicago, IL (US)

( * ) Notice: Subject to any disclaimer, the term of this patent is extended or adjusted under 35 U.S.C. 154(b) by 0 days.

(21) Appl. No.: 15/204,253

(22) Filed: Jul. 7, 2016

(65) Prior Publication Data

US 2018/0010310 A1 Jan. 11, 2018

(51) Int. Cl.
*E01H 5/06* (2006.01)
*E01H 5/00* (2006.01)

(52) U.S. Cl.
CPC ..... *E01H 5/066* (2013.01); *E01H 5/00* (2013.01); *E01H 5/061* (2013.01)

(58) Field of Classification Search
CPC ..... E02F 3/404; E02F 3/962; E02F 3/7622; E01H 5/04; E01H 5/06; E01H 5/062; E01H 5/066; E01H 5/00; E01H 5/061
USPC ..... 37/468, 407, 233, 266, 271, 232; 172/684.5, 701.1–701.3, 832
See application file for complete search history.

(56) References Cited

U.S. PATENT DOCUMENTS 2,347,963 A * 5/1944 O'Neill ..... A47L 13/08 15/105
3,202,226 A * 8/1965 Carson ..... E02F 3/8152 172/701.3
3,477,149 A * 11/1969 Wagner ..... E01H 5/061 15/245
3,666,020 A * 5/1972 Hess ..... E01H 4/02 15/236.06
4,450,635 A * 5/1984 Shwayder ..... E01H 5/061 228/189
4,819,349 A * 4/1989 Mensch ..... E02F 3/404 172/684.5
5,075,985 A * 12/1991 Mensch ..... A01B 31/00 15/245
5,471,770 A * 12/1995 Ferreira ..... E01H 5/061 172/719

(Continued)

OTHER PUBLICATIONS

Northern Tool + Equipment, "Meyer Super-V Bottom-Trip Rubber Cutting Edge Kit", 3. http://www.northerntool.com/shop/tools/product_200488200_200488200?cm_mmc=Google-pla&utm_source=Google_PLA&utm_medium=Snow%20%2B%20Ice%20Removal%20%3E%20Snowplow%20Replacement%20Parts&utm_campaign=Meyer%20Products&utm_content=23878&gclid=CjwKEAjwi9K4BRCQzq7d1c6A_XASJABueAO2u8nZnvMc9Rj-Dq8E56T_8WqZC4uiTis4En433a10XxoC_urw_wcB (Available prior to Jul. 7, 2016), 2 pages.

*Primary Examiner* — Robert E Pezzuto
(74) *Attorney, Agent, or Firm* — Neal, Gerber & Eisenberg LLP

(57) ABSTRACT

A plow blade wear member having a slower wear rate than known blade wear members, and having a reduced tendency to partially break off, fracture, chip, or become otherwise damaged when the blade wear member engages a discontinuity in a travel surface. In various embodiments of the present disclosure, the blade wear member is formed or cut from a used airplane tire. In various embodiments of the present disclosure, the blade wear member is formed or cut from a used fiber reinforced airplane tire having a relatively large outer circumference to provide the desired radius of curvature, the desired thickness, and the desired strength for the blade wear member.

32 Claims, 8 Drawing Sheets

(56) References Cited

U.S. PATENT DOCUMENTS

| | | | | |
|---|---|---|---|---|
| 6,256,910 | B1 | 7/2001 | Grozde | |
| 6,865,826 | B1 | 3/2005 | Lakin | |
| 7,918,042 | B2 | 4/2011 | Ropog | |
| 8,732,989 | B1 | 5/2014 | Turnbull | |
| 8,984,778 | B2 * | 3/2015 | Fox | E01H 5/062 37/266 |
| 9,290,898 | B2 * | 3/2016 | Abramczyk | E01H 5/062 |
| 2003/0182824 | A1 * | 10/2003 | Coffin | E01H 5/066 37/266 |
| 2003/0221338 | A1 | 12/2003 | Verseef | |
| 2004/0161327 | A1 | 8/2004 | Paxton et al. | |
| 2008/0072464 | A1 | 3/2008 | Kost et al. | |
| 2011/0138660 | A1 | 6/2011 | Van Laecken | |

* cited by examiner

PLOW BLADE WEAR MEMBER

BACKGROUND

Snow is removed from the ground or other travel surfaces such as roads, runways, driveways, bridges, parking lots, sidewalks, and the like for purposes of safety and improved user movement or travel. Various known snowplows are used to remove snow from such travel surfaces. Such known snowplows are typically either: (a) a dedicated type snowplow; or (b) a temporary type snowplow including a suitable blade assembly connected to a vehicle used for multiple purposes (such as a garbage truck, a dump truck, a pickup truck).

Snowplows typically push along the travel surfaces and thus regularly experience significant and potentially damaging wear and forces due to the engagement with such travel surfaces. Travel surfaces are often paved or covered with gravel, sand, asphalt, concrete, or other similarly abrasive materials. Travel surfaces also often have bumps, potholes, cracks, rumble strips, steps, manholes, manhole covers, or other discontinuities that significantly alter the contours of the travel surfaces. Frequent engagement with these travel surfaces and discontinuities can cause wear and can damage a snowplow, and particularly the blade of the snowplow.

To address these problems, snowplows typically include blade assemblies that include springs that support the blade, bias the blade toward the travel surface, and provide for or enable upward and/or rearward movement or pivoting of the blade when the blade encounters an uneven travel surface or other discontinuity.

To address these problems, known snowplow blade assemblies also typically include a blade wear member removably attached to the bottom of the snowplow blade. This blade wear member is configured to engage the travel surface and configured to wear out during use. This blade wear member protects the bottom of the blade from direct engagement with the travel surface and thus minimizes wear on and damage to the bottom of the blade from such engagements.

Such known snowplow blade wear members often include a straight or flat somewhat flexible rubber wear strip configured to be attached to the bottom of the blade. As the bottom edge of such known blade wear members engage the ground surface to direct the snow, the rubber blade wear members tend to rapidly wear. Such worn rubber blade wear members can become less efficient or ineffective.

As the bottom edge of such known blade wear members engage the ground surface to direct the snow, the rubber blade wear members also tend to partially break off, fracture, chip, or become otherwise damaged when the blade wear members engage a discontinuity in the travel surface such as a bump, pothole, crack, rumble strip, step, manhole, or manhole cover. Such damaged rubber blade wear members can become less efficient or ineffective.

The quicker the blade wear member wears down or is damaged, the more often the blade wear member needs to be replaced, and the more costly it is to operate the snowplow. Additionally, when a blade wear member wears down or is damaged, the engagement with the travel surface is less even and the performance of the snowplow suffers, which in turn can increase the time and expense necessary to clear the snow from the travel surfaces.

Therefore, a need exists for better snowplow blade wear members that provide improved engaging function between the blade and the travel surface, that wear down at a substantially slower rate than known snowplow blade wear members, and that minimize the tendency of the blade wear member to partially break off, fracture, chip, or become otherwise damaged when the blade wear member engages a discontinuity in the travel surface.

There also exists a continuing need for uses for used tires to prevent used tires from being disposed of in landfills.

SUMMARY

Various embodiments of the present disclosure provide a plow blade wear member, such as a snowplow blade wear member that solves the above problems by providing a blade wear member having a slower wear rate than known blade wear members, and having a reduced tendency to partially break off, fracture, chip, or become otherwise damaged when the blade wear member engages a discontinuity in a travel surface.

More specifically, the plow blade wear member is configured to be removably and adjustably attached to a blade of a blade assembly that is attached or attachable to a vehicle. The vehicle and the blade assembly generally form the plow. The blade wear member, the blade assembly, and the vehicle are configured to operate as a snowplow, although it should be appreciated that the blade wear member of the present disclosure can be employed for or in conjunction with plow blades other than snowplow blades. Thus, the present disclosure also provides: (a) a plow blade assembly including the plow blade wear member (such as a snowplow blade assembly with a snowplow blade wear member); and (b) a plow vehicle including a plow blade assembly with the blade wear member (such as a snowplow vehicle including a snowplow blade assembly with the snowplow blade wear member).

This blade wear member of various embodiments of the present disclosure includes an elongated curved or arched body having a first or top edge, a second or bottom edge, a third or right side edge, a fourth or left side edge, a front concave surface, and a rear convex surface. The blade wear member defines a plurality of spaced apart oval attachment slots that enable the blade wear member to be attached to a blade in each of a plurality of different positions or heights relative to the blade or bottom edge of the blade.

As the blade wear member moves along a travel surface, the blade wear member or bottom part is strong enough to not flex or bend backward against its natural curvature when the blade wear member, or part thereof, engages an object or discontinuity protruding from the travel surface at a designated force level. However, when the blade wear member moves along a travel surface and engages an object or discontinuity protruding from the travel surface above the designated force level, the blade wear member or bottom part thereof, can flex or bend backward against its natural curvature. The natural curvature of the blade wear member causes the blade wear member to be biased back to or return to its original shape or position.

In various embodiments of the present disclosure, the blade wear member is formed or cut from an airplane tire. In various embodiments of the present disclosure, the blade wear member is formed or cut from a used fiber reinforced airplane tire having a relatively large outer circumference to provide the desired radius of curvature, the desired thickness, and the desired strength for the blade wear member of the present disclosure.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
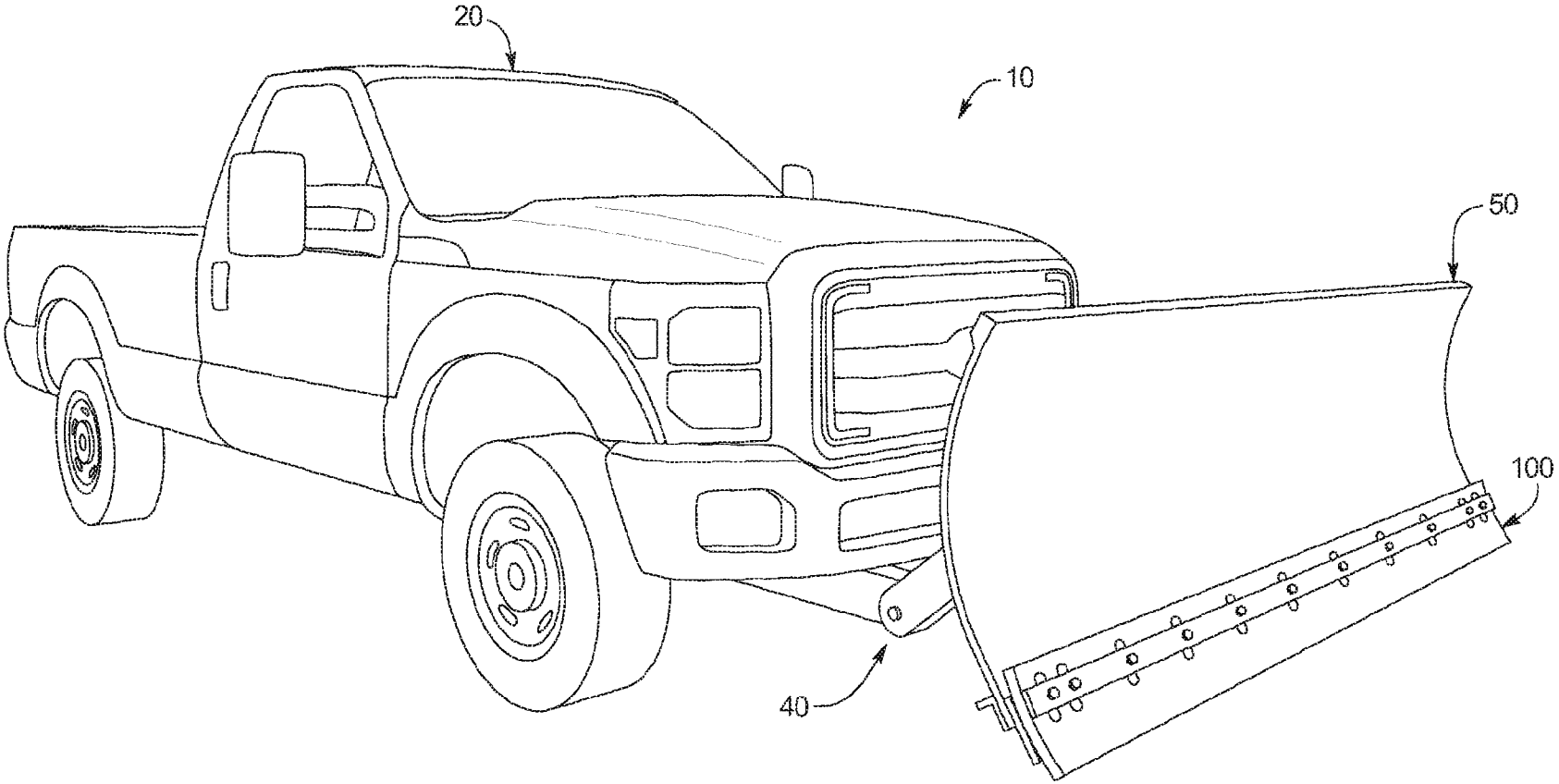
FIG. 1 is a front perspective view of snowplow including a truck, a blade assembly (including a blade) attached to the truck, and a blade wear member of one example embodiment of the present disclosure attached to the blade.
Figure 2:
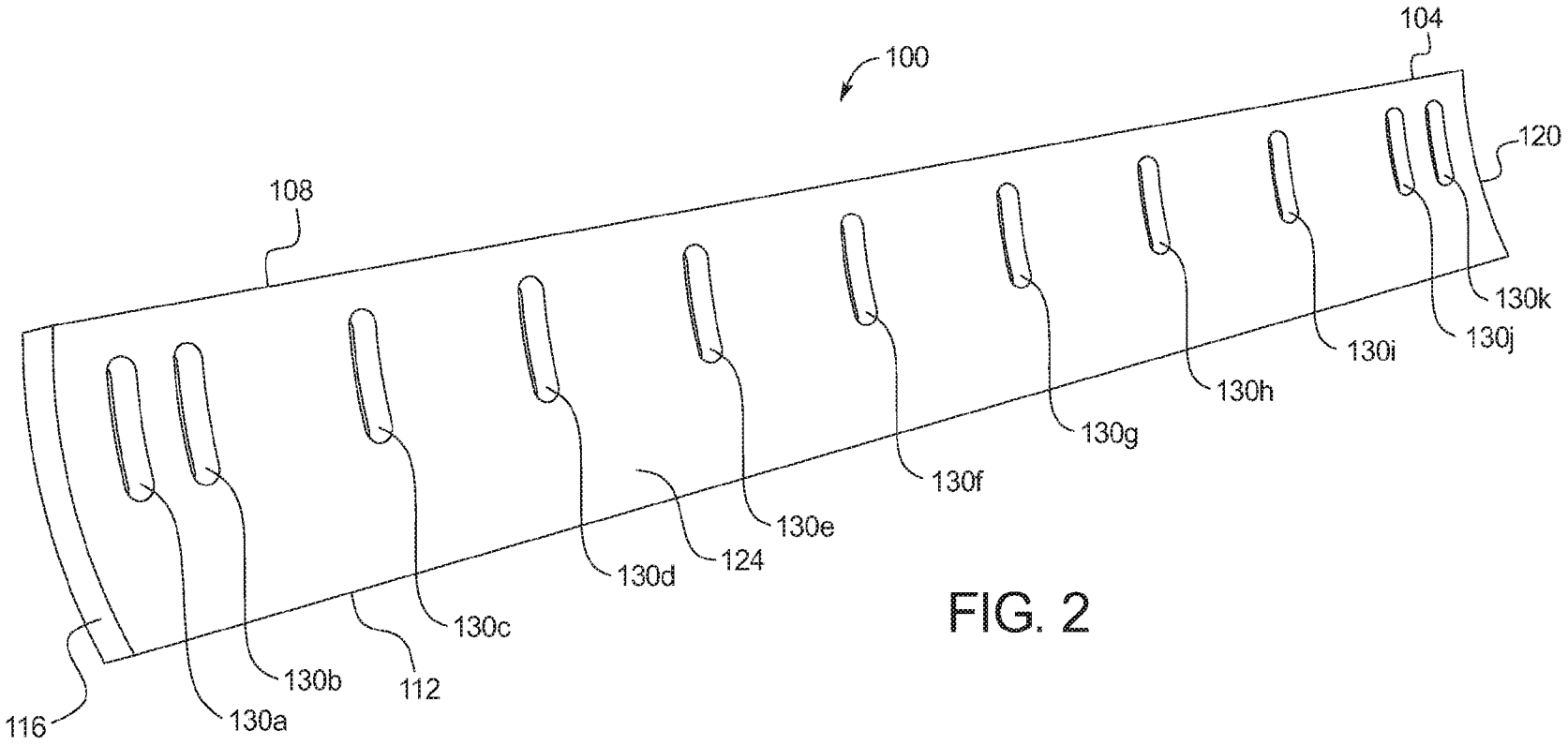
FIG. 2 is a front perspective view of the blade wear member of FIG. 1.
Figure 3:
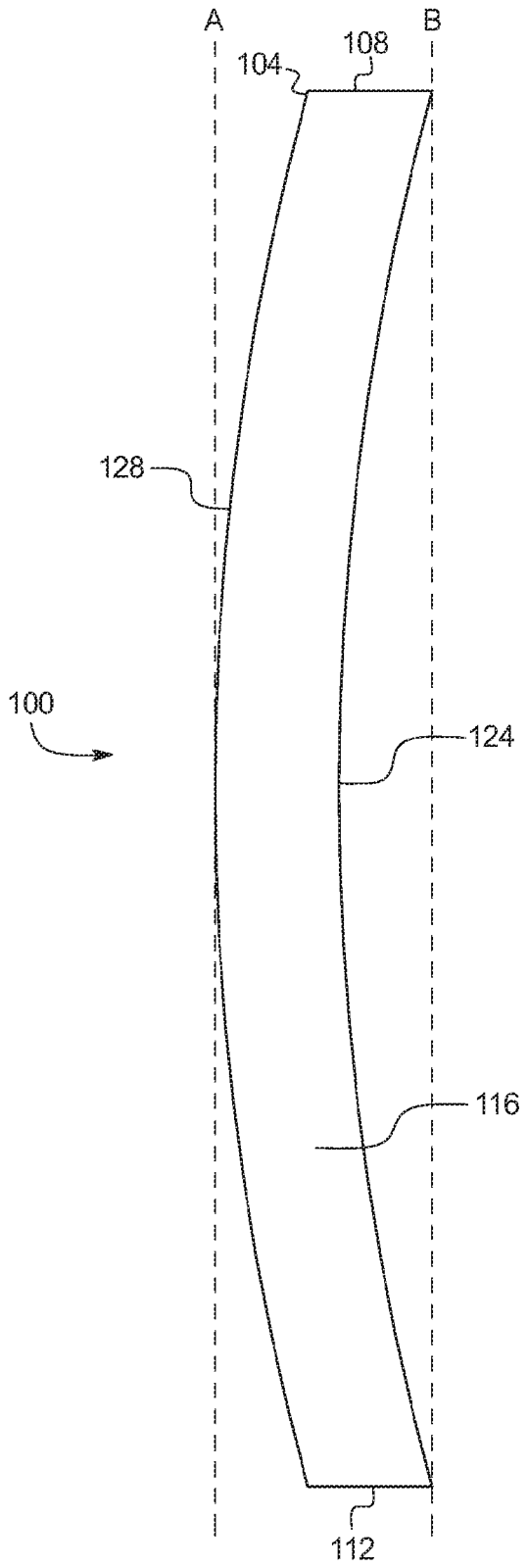
FIG. 3 is a end view of the blade wear member of FIG. 1.
Figure 4:
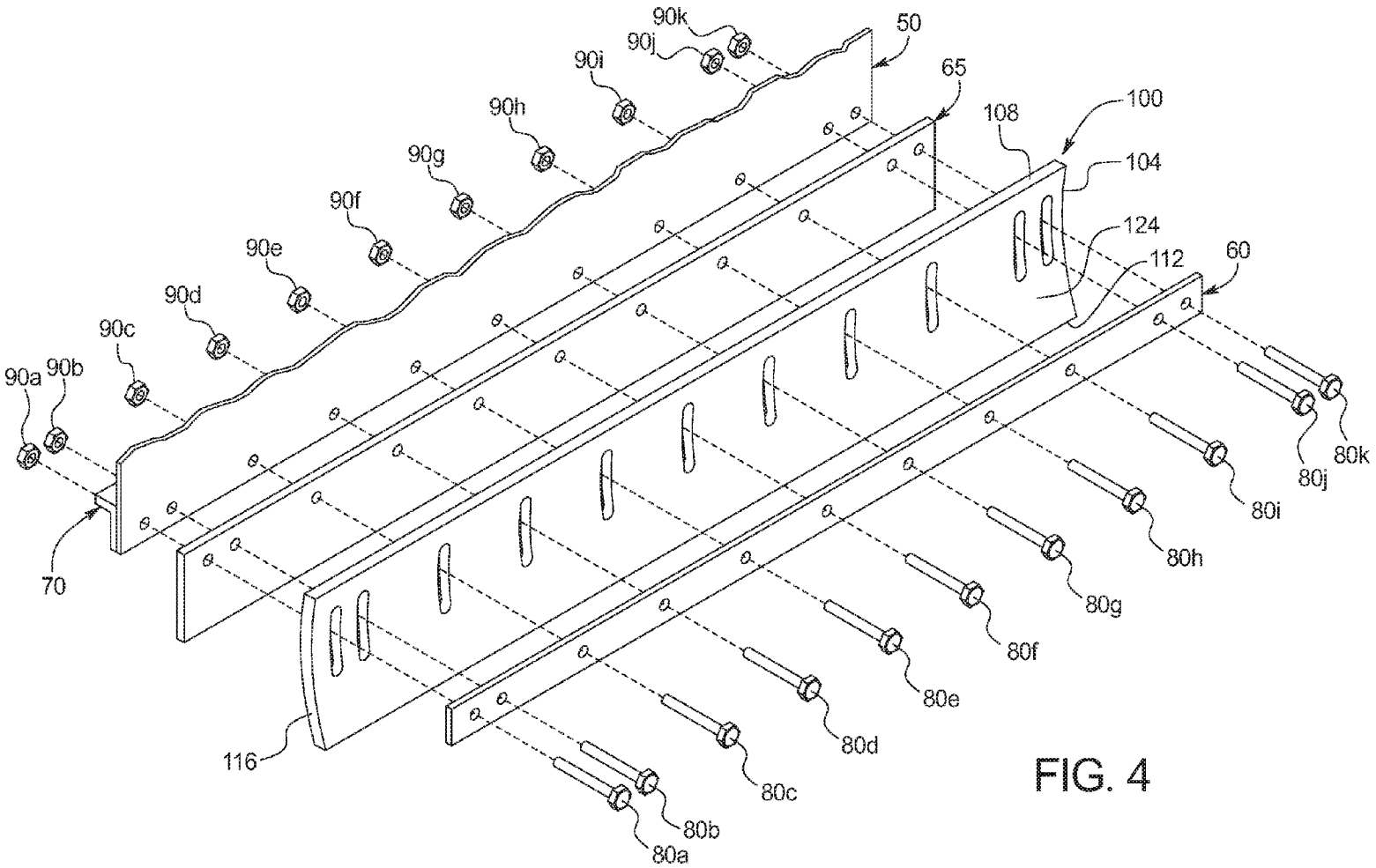
FIG. 4 is an exploded front perspective view of the blade wear member of FIG. 1, an example blade wear member attachment assembly of one embodiment of the present disclosure, and a fragmentary bottom portion of a blade.

The present disclosure solves the above problems by providing a blade wear member having a slower wear rate than known blade wear members, and also by providing a blade wear member having a reduced tendency to partially break off, fracture, chip, or become otherwise damaged when the blade wear member engages a discontinuity in a travel surface.

Referring now to the drawings and particularly to FIGS. 1, 2, 3, 4, 5, 6, and 7, the blade wear member of one example embodiment of the present disclosure is generally illustrated and indicated by numeral 100. The illustrated example plow blade wear member 100 is configured to be removably and adjustably attached to a blade 50 of a blade assembly 40 that is attached or attachable to a vehicle 20. The vehicle 20 and the blade assembly 40 generally form a plow 10. In this illustrated embodiment, the blade wear member 100, the blade assembly 40, and the vehicle 20 are configured to operate as a snowplow, although it should be appreciated that the blade wear member of the present disclosure can be employed for or in conjunction with plow blades other than snowplow blades.

In this illustrated example embodiment, blade wear member 100 includes an elongated curved or arched body 104 having a first or top edge 108, a second or bottom edge 112, a third or right side edge 116, a fourth or left side edge 120, a front concave surface 124, and a rear convex surface 128. In this illustrated example embodiment, the blade wear member 100 includes a single body 104; however, it should be appreciated that the blade wear member can alternatively include two or more bodies that co-act to form the entire blade wear member and that are configured to be attached to a single blade as further discussed below with respect to FIG. 8.

The blade wear member 100 in this illustrated example embodiment has: (a) the first or top edge 108 extending parallel or substantially parallel to the second or bottom edge 112; (b) the third or right side edge 116 extending parallel or substantially parallel to the fourth or left side edge 120; and (c) the front concave surface 124 having the same or substantially the same arc or radius of curvature as the rear convex surface 128. In alternative embodiments of the blade wear member of the present disclosure: (a) the first or top edge and the second or bottom edge extend in intersecting planes; (b) the third or right side edge and the fourth or left side edge extend in intersecting planes; and/or (c) the front concave surface and the rear convex surface extend toward each other at the top section or the bottom section. The blade wear member 100 in this illustrated example embodiment has a substantially uniform thickness: (a) from the first or top edge 108 to the second or bottom edge 112; and (b) from the third or right side edge 116 to the fourth or left side edge 120. In alternative embodiments of the blade wear member of the present disclosure, the blade wear member has a non-uniform thickness: (a) from the first or top edge 108 to the second or bottom edge 112; and/or (b) from the third or right side edge 116 to the fourth or left side edge 120.

This illustrated example blade wear member 100 provides a desired curvature, thickness, and strength that are optimized for attachment to a plow blade, and particularly a snowplow blade. In this illustrated embodiment, the thickness of the blade wear member is at least approximately one inch. In this illustrated embodiment, the radius of curvature of the blade wear member is approximately 40 inches. In this illustrated embodiment, the distance from plane A (indicated by dotted line in FIG. 3) to plane B (indicated by dotted line in FIG. 3) is approximately 1.125 inches. It should be appreciated that in other embodiments of the present disclosure, the curvature, thickness, and strength of the plow blade wear member can vary.

The body 104 of this illustrated example blade wear member 100 defines a series of substantially horizontally aligned, off center, substantially vertically extending, spaced apart, oval attachment slots 130*a*, 130*b*, 130*c*, 130*d*, 130*e*, 130*f*, 130*g*, 130*h*, 130*i*, 130*j*, and 130*k*. The oval attachment slots 130*a*, 130*b*, 130*c*, 130*d*, 130*e*, 130*f*, 130*g*, 130*h*, 130*i*, 130*j*, and 130*k* extend though the entire body 104, and particularly from the front concave surface 124 to the rear convex surface 128. As shown in FIGS. 2, 4, 5, and 7, the oval shapes of the series of spaced apart attachment slots 130*a*, 130*b*, 130*c*, 130*d*, 130*e*, 130*f*, 130*g*, 130*h*, 130*i*, 130*j*, and 130*k* enable the blade wear member 100 to be attached to a blade such as blade 50 at spaced apart locations along the blade 50, and in each of a plurality of different positions or heights relative to the blade 50 or bottom edge of the blade 50.

More specifically, in this illustrated embodiment, as best seen in FIGS. 1, 4, 5, 6, and 7, the present disclosure includes a blade wear member attachment assembly including a front attachment bar 60, a rear attachment plate 65, a blade support 70, and a plurality of fasteners (such as bolts

80*a*, 80*b*, 80*c*, 80*d*, 80*e*, 80*f*, 80*g*, 80*h*, 80*i*, 80*j*, and 80*k*, and nuts 90*a*, 90*b*, 90*c*, 90*d*, 90*e*, 90*f*, 90*g*, 90*h*, 90*i*, 90*j*, and 90*k*) configured to attach the blade wear member 100 to the bottom section of the blade 50. The front attachment bar 60, the rear attachment plate 65, the blade 50, and the blade support 70 each include or define a corresponding series of openings such that the bolts 80*a*, 80*b*, 80*c*, 80*d*, 80*e*, 80*f*, 80*g*, 80*h*, 80*i*, 80*j*, and 80*k* can extend though the front attachment bar 60, the blade wear member 100, the rear attachment plate 65, the blade 50, and the blade support 70, and such that the nuts 90*a*, 90*b*, 90*c*, 90*d*, 90*e*, 90*f*, 90*g*, 90*h*, 90*i*, 90*j*, and 90*k* can be attached to the bolts 80*a*, 80*b*, 80*c*, 80*d*, 80*e*, 80*f*, 80*g*, 80*h*, 80*i*, 80*j*, and 80*k* to secure such components together as generally shown in FIGS. 1, 5, 6, and 7. The blade wear member 100 is positioned or sandwiched between the attachment bar 60 and the rear attachment plate 65 in this illustrated embodiment. It should be appreciated that other suitable blade wear member attachment assemblies can be used to attach the blade wear member 100 to the blade 50 in accordance with the present disclosure.

Figure 5:
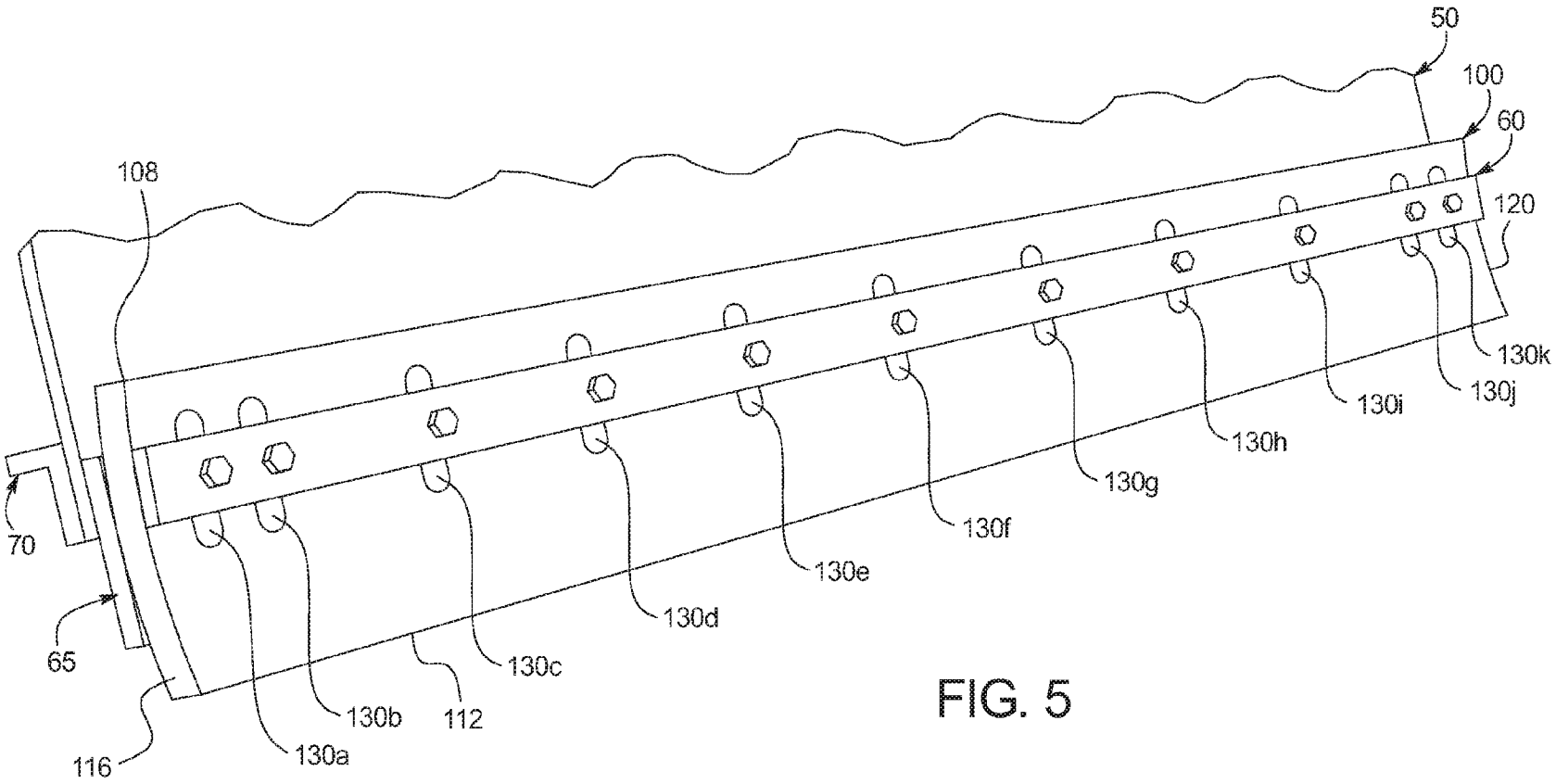
FIG. 5 is an assembled front perspective view of the blade wear member of FIG. 1, the example blade wear member attachment assembly of FIG. 4, and a fragmentary bottom portion of a blade, and showing the blade wear member attached to the bottom of the blade in a first position.
Figure 7:
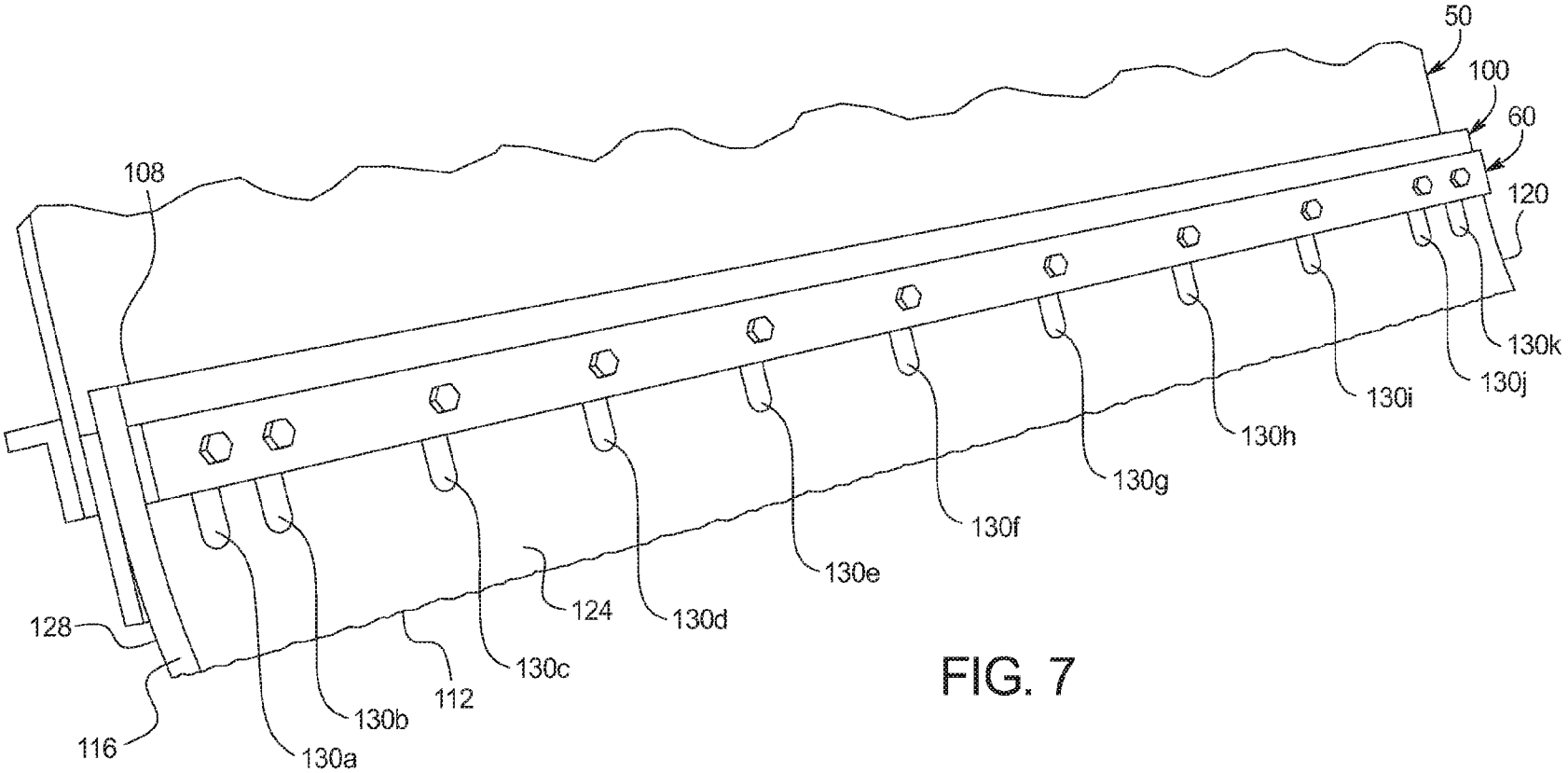
FIG. 7 is an assembled front perspective view of the blade wear member of FIG. 1, the example blade wear member attachment assembly of FIG. 4, and a fragmentary bottom portion of a blade, and showing the blade wear member attached to the bottom of the blade in another one of the plurality of different positions or heights.

As mentioned above, the oval shapes of the attachment slots 130*a*, 130*b*, 130*c*, 130*d*, 130*e*, 130*f*, 130*g*, 130*h*, 130*i*, 130*j*, and 130*k* enable the blade wear member 100 to be attached to a blade at various different heights. FIG. 5 shows the blade wear member 100 attached to the blade 50 at an intermediate position relative to the blade 50. After the bottom second edge 112 of the blade wear member 100 wears down a designated amount or to a designated level (as shown in FIG. 7), the blade wear member 100 can be moved or adjusted downwardly one or more times and eventually such that the blade wear member 100 is attached to the blade 50 at the lowest position relative to the blade 50 for the series of attachment slots 130*a*, 130*b*, 130*c*, 130*d*, 130*e*, 130*f*, 130*g*, 130*h*, 130*i*, 130*j*, and 130*k*. FIG. 7 shows the blade wear member 100 attached to the blade 50 at this lowest position relative to the blade 50 for the series of attachment slots 130*a*, 130*b*, 130*c*, 130*d*, 130*e*, 130*f*, 130*g*, 130*h*, 130*i*, 130*j*, and 130*k*.

In certain embodiments of the present disclosure, after the first edge 112 of the blade wear member 100 has been further worn down to a further level, the blade wear member 100 can detached from the blade 50, turned upside down, and reattached to the blade 50 such that the series of attachment slots 130*a*, 130*b*, 130*c*, 130*d*, 130*e*, 130*f*, 130*g*, 130*h*, 130*i*, 130*j*, and 130*k* are used to attach the blade wear member 100 to the blade 50 in an upside down position. In other embodiments of the present disclosure that are not shown, a second series of horizontally aligned spaced apart attachment slots may be employed to accomplish the additional or alternative use or attachment.

Figure 6:
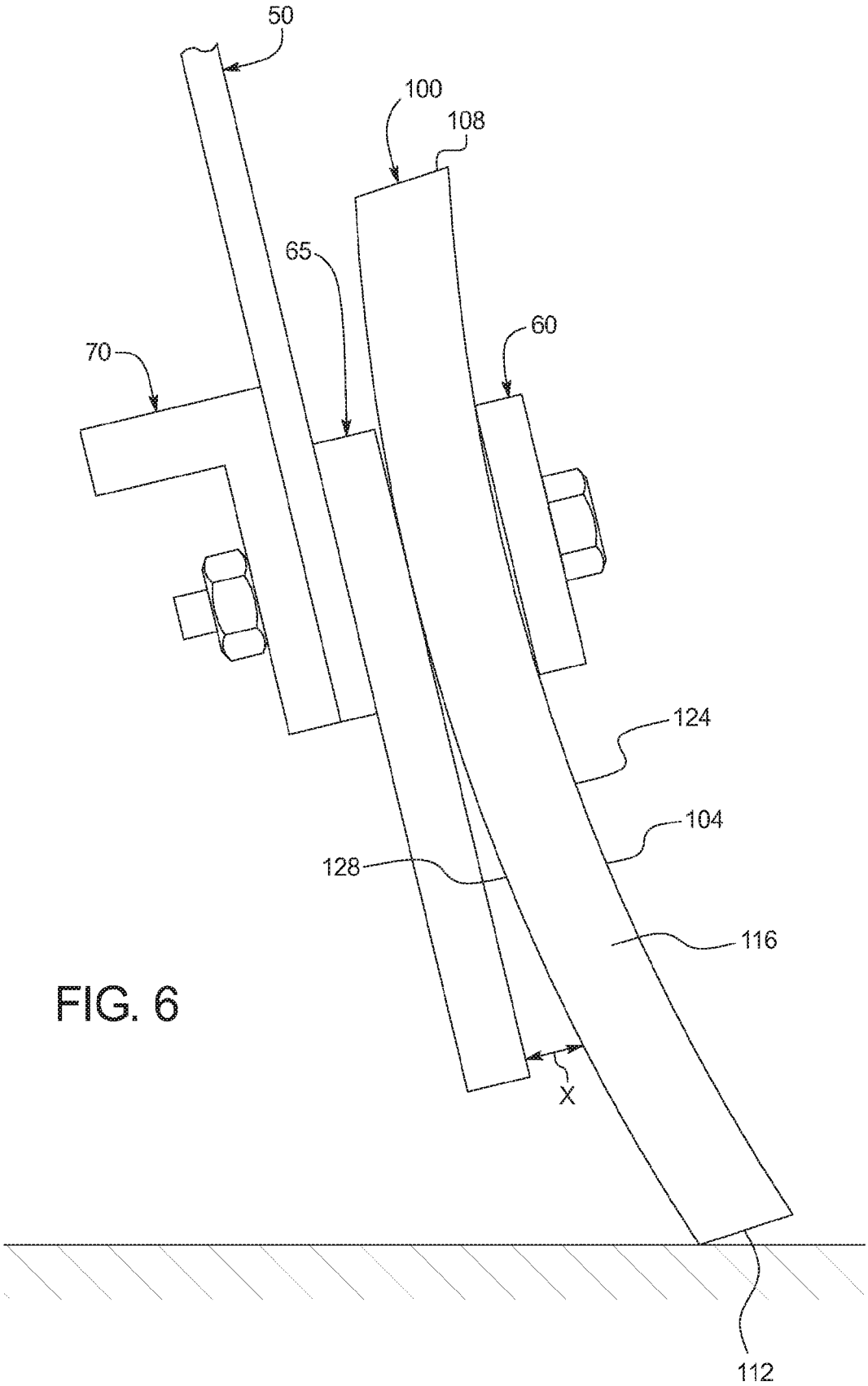
FIG. 6 is an assembled end view of the blade wear member of FIG. 1, the example blade wear member attachment assembly of FIG. 4, and a fragmentary bottom portion of a blade, and showing the blade wear member attached to the bottom of the blade in one of a plurality of different position or heights.

The blade wear member 100 has a natural curvature (i.e., is curved in the normal or resting state). FIG. 6 best illustrates the curvature of the blade wear member 100 relative to the blade 50 and the rear attachment plate 65. FIG. 6 also illustrates that the bottom portion of the convex surface 128 of the curved blade wear member 100 is spaced apart from the rear attachment plate 65 a distance X, which in this illustrated example embodiment is approximately 0.25 inches at the lowest point of the rear attachment plate 65. FIG. 6 further shows that the gap between the curved blade wear member 100 and the rear attachment plate 65 narrows in an upward direction.

As the blade wear member 100 moves along a travel surface, the blade wear member 100 or bottom part thereof is strong enough to not flex or bend backward against its natural curvature when the blade wear member 100 or part thereof engages an object or discontinuity protruding from the travel surface at a designated force level. However, when the blade wear member 100 moves along a travel surface and engages an object or discontinuity protruding from the travel surface at a force level above the designated force level, the blade wear member 100 or bottom part thereof can flex or bend backward against its natural curvature. For example, the blade wear member 100 or bottom part thereof can flex or bend backward the entire distance X which is 0.125 inches in this illustrated example embodiment. The natural curvature of the blade wear member 100 causes the blade wear member 100 to be biased back to or return to its original shape or position. The gap between the curved blade wear member 100 and the rear attachment plate 65 facilitates this rearward bending of the bottom portion of the blade wear member 100 without causing damage to the blade wear member 100.

In this illustrated example embodiment, the blade 50, the front attachment bar 60, the rear attachment plate 65, and the blade support 70, the bolts 80*a*, 80*b*, 80*c*, 80*d*, 80*e*, 80*f*, 80*g*, 80*h*, 80*i*, 80*j*, and 80*k*, and the nuts 90*a*, 90*b*, 90*c*, 90*d*, 90*e*, 90*f*, 90*g*, 90*h*, 90*i*, 90*j*, and 90*k*, are all formed from a suitable metal such as steel. It should be appreciated that the blade 50, the front attachment bar 60, the rear attachment plate 65, the blade support 70, the bolts 80*a*, 80*b*, 80*c*, 80*d*, 80*e*, 80*f*, 80*g*, 80*h*, 80*i*, 80*j*, and 80*k*, and the nuts 90*a*, 90*b*, 90*c*, 90*d*, 90*e*, 90*f*, 90*g*, 90*h*, 90*i*, 90*j*, and 90*k*, can be formed from other suitable materials. It should further be appreciated that the rear attachment plate 65 is in part used to prevent damage to the blade 50. If the rear attachment plate 65 is damaged, it is much less expensive and time consuming to replace the rear attachment plate 65 than the blade 50.

In various embodiments of the present disclosure, the blade wear member is formed from multiple plies of a flexible material or element, such as rubber, to provide enhanced wear characteristics and to have the rigidity necessary for engaging a travel surface.

In various embodiments of the present disclosure, each layer or ply of the blade wear member of the present disclosure has a reinforcing material (such as a polymer material, a polyester material, a nylon or aliphatic or semi-aromatic polyamide material, a rayon or regenerated cellulose material, or a synthetic material) that reinforces the flexible material of the blade wear member to provide greater tensile strength. The flexible material is coupled with or bonded around each fiber of reinforcing material in various embodiments.

In various embodiments of the present disclosure, the blade wear member includes a plurality of layers or plies of reinforcing material integrated within a plurality of layers of flexible material. The quantity of reinforcing layers may vary in accordance with the present disclosure.

In various embodiments of the present disclosure, each layer of reinforcing material includes one ply of fibers angled in one direction and at least one other ply of fibers laid on top of or adjacent to the first ply at a substantially non-perpendicular different angle.

In various embodiments of the present disclosure, the multiple plies and the configuration in which the reinforcing material is positioned or layered within each ply causes (when the blade wear member is formed), the bottom edge or working edge of the blade wear member to include a plurality or pattern of indentations, serrations, or dimples. This pattern substantially decreases wear of the blade wear member In various embodiments of the present disclosure, the blade wear member is formed from a plurality of separate pieces that are attached or otherwise suitably joined together to form the blade wear member.

In various embodiments of the present disclosure, the blade wear member is formed or cut from a used airplane tire.

In various embodiments, the blade wear member is formed or cut from a used airplane tire by: (a) removing the bead of the airplane tire; (b) trimming the remaining portion of the airplane tire to obtain a strip from the circumference of the airplane tire; (c) shaving the strip to the proper thickness if necessary; and (d) die cutting the shaved strip to the desired specifications (such as length).

In various embodiments of the present disclosure, the blade wear member is formed or cut from a used fiber reinforced airplane tire having an outer circumference of approximately 120 inches and a diameter of approximately 50 inches (such as a polymer fiber reinforced, polyester fiber reinforced, nylon or aliphatic or semi-aromatic polyamide fiber reinforced, rayon or regenerated cellulose fiber reinforced, or synthetic fiber reinforced airplane tire having an outer circumference of approximately 120 inches and a diameter of approximately 50 inches). Such airplane tires provide the desired radius of curvature, the desired at least approximately one inch thickness for the blade wear member, and the desired strength of the blade wear member. The curvature of the blade wear member formed or cut from a used airplane tire provides a desired spring action or resistance that causes the blade wear member to return to its normal position after being engaged by a discontinuity in the travel surface above certain force levels.

In various embodiments of the present disclosure, the blade wear member is formed or cut from a used airplane tire in lengths from six feet up to fifteen feet long. In various embodiments of the present disclosure, the aircraft tire employed has a one inch thickness and has a four foot height. The four foot height tire provides the desired radius of curvature for the blade wear member as explained above. In various embodiments of the present disclosure, the aircraft tire employed is up to ten feet wide.

Thus, in various embodiments of the present disclosure, the blade wear member is formed from a vulcanized rubber that has been treated with chemicals to improve the physical properties of the rubber and thus prevent the rubber from breaking down. Since the characteristics of vulcanized rubber prevent the rubber from being broken down and recycled similar to common plastics, the present disclosure provides an alternative use for existing used or worn out airplane tires. By utilizing vulcanized airplane tire rubber, the present disclosure provides the additional advantage of preventing the buildup of airplane tires in landfills.

In various embodiments of the present disclosure, the blade wear member is formed from the airplane tire by die cutting the airplane tire under compression such that each ply and the flexible material extends further than the plurality of reinforcing fibers that lay within that ply and the flexible material. However, since the reinforcing fibers are coupled to or bonded with the flexible material, as the flexible material expands, the fibers will be pulled or stretched along with the expanding flexible material. It should be appreciated that with the different thicknesses of the flexible material and not a lower coefficient of expansion, as the reinforcing fibers are pulled, a greater proportion of the reinforcing fibers, relative to the overall size, are stretched to expand substantially the same distance as the flexible material, and when the die cuts through the reinforcing material, a greater length of reinforcing material than the flexible material is cut. When the flexible material decompresses, the stretched reinforcing fibers (that have actually been cut more than the rubber material) will retract a greater distance than the flexible material to cause a plurality of indentations, serrations or dimples. That is, as described above, as a greater proportion (relative to their overall size) of the reinforcing fibers were stretched than the flexible material and subsequently cut away, less of the reinforcing fibers (proportionate to overall size) remain after the cut. In other words, when the flexible material and the reinforcing fibers retract to their pre-compression state, less of the fibers will remain (in proportion to their overall size) and thus the fibers will retract a greater distance than the flexible material, leaving an uneven edge or surface for each ply of the blade wear member. As described above, as the fibers and flexible material are coupled or bonded to each other, as the fibers retract, portions of the flexible material will retract more than other portions revealing the dimples. The indentations are formed in the flexible material around where the fiber has retracted.

The plurality of dimples provide a decreased amount of surface area for the blade wear member to engage the travel surface while still performing substantially the same function as a smooth edged blade wear member. When the bottom or working edge engages the ground surface to push snow, only the non-indented portion of the blade wear member edge will directly engage the ground surface. That is, without the entire edge of the blade wear member engaging the ground surface, the blade wear member edge will not be worn away as quickly and the blade wear member will not need to be replaced as often.

In various embodiments of the present disclosure, the blade wear member includes two or more different integrally connected sections or layers. The sections or layers are different in the spacing between the reinforcing fibers in each section or layer. In certain such embodiments, the first or inner layer includes the reinforcing fibers spaced relatively close together (in the direction from the concave front surface to the convex rear surface), and a second or outer layer including the reinforcing fibers spaced further apart (in the direction from the concave front surface to the convex rear surface).

Figure 8:
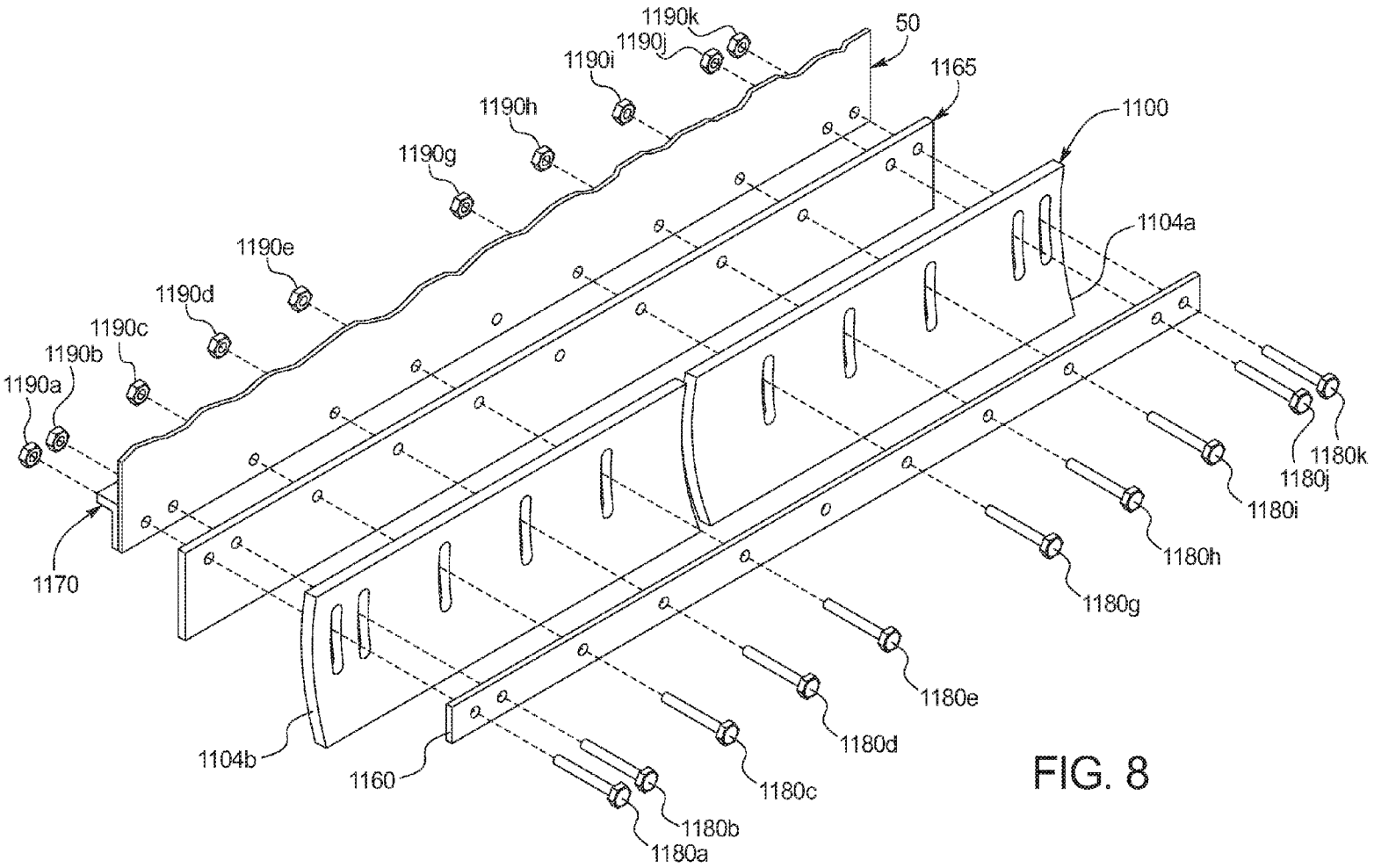
FIG. 8 is an exploded front perspective view of another embodiment of the blade wear member of the present disclosure, an example blade wear member attachment assembly of one embodiment of the present disclosure, and a fragmentary bottom portion of a blade, wherein the blade wear member includes two bodies.

Referring now to FIG. 8, the plow blade wear member of another example embodiment of the present disclosure is generally illustrated and indicated by numeral 1100. The illustrated example plow blade wear member 1100 is configured to be removably and adjustably attached to a blade 50 of a blade assembly that is attached or attachable to a vehicle. In this illustrated embodiment, the blade wear member 1100 includes multiple elongated curved or arched bodies 1104*a* and 1104*b*. In this embodiment, body 1104*a* has a first or top edge, a second or bottom edge, a third or right side edge a fourth or left side edge, a front concave surface, and a rear convex surface. In this embodiment, body 1104*b* also has a first or top edge, a second or bottom edge, a third or right side edge, a fourth or left side edge, a front concave surface, and a rear convex surface. In this embodiment, a blade wear member attachment assembly including a front attachment bar 1160, a rear attachment plate 1165, a blade support 1170, and a plurality of fasteners (such as bolts 1180*a*, 1180*b*, 1180*c*, 1180*d*, 1180*e*, 1180*g*, 1180*h*, 1180*i*, and 1180*j*, and 1180*k*, and nuts 1190*a*, 1190*b*, 1190*c*, 1190*d*, 1190*e*, 1190*g*, 1190*h*, 1190*i*, 1190*j*, and 1190*k*) is used to attach each of the bodies 1104*a* and 1104*b* of the blade wear member 1100 to the blade 50. In this illustrated example embodiment, the middle bolt and middle nut is not used. In this embodiment, the blade wear member bodies 1104*a* or 1104*b* can be replaced if damaged or worn without having to replace the other body. It should thus be appreciated from this alternative embodiment that the blade wear member of the present disclosure alternatively includes two or more bodies that form the entire blade wear member and that are configured to be attached to a single blade.

It should be appreciated from the above that various embodiments of the present disclosure provide a plow blade wear member (such as a snowplow blade wear member) that solves the above problems. It should also be appreciated from the above that various embodiments of the present disclosure provide a plow blade assembly with the plow blade wear member (such as a snowplow blade assembly with a snowplow blade wear member). It should further be appreciated from the above that various embodiments of the present disclosure provide a plow vehicle with a plow blade assembly including the blade wear member (such as a snowplow vehicle with a snowplow blade assembly including the snowplow blade wear member).

It will be understood that modifications and variations may be effected without departing from the scope of the novel concepts of the present disclosure, and it is understood that this application is to be limited only by the scope of the claims.

The invention is claimed as follows:

1. A plow blade wear member comprising:

an elongated curved body formed from an airplane tire and having:

a top edge, a bottom edge, a right side edge, a left side edge, a front concave surface, and a rear convex surface, and being flexible enough to bend backward a distance toward a rear attachment plate to which the elongated curved body is attached and against its natural curvature when the plow blade wear member engages a discontinuity protruding from a travel surface at a force level above a designated force level, and such that the backward bending of the elongated curved body the distance toward the rear attachment plate reduces a gap between the elongated curved body and the rear attachment plate;

said elongated curved body defining a first series of attachment slots that enable the elongated curved body to be removably and adjustably attached to a blade of a blade assembly attachable to a vehicle.

2. The plow blade wear member of claim 1, wherein the elongated curved body includes a plurality of curved bodies.

3. The plow blade wear member of claim 1, wherein the top edge extends substantially parallel to the bottom edge, the right side edge extends substantially parallel to the left side edge, and the front concave surface has substantially the same curvature as the rear convex surface.

4. The plow blade wear member of claim 1, wherein the top edge and the bottom edge extend in intersecting planes, and the right side edge and the left side edge extend in intersecting planes.

5. The plow blade wear member of claim 1, wherein the front concave surface and the rear convex surface extend toward each other at a top section or a bottom section of the elongated curved body.

6. The plow blade wear member of claim 1, wherein the elongated curved body has a uniform thickness from the top edge to the bottom edge, and from the right side edge to the left side edge.

7. The plow blade wear member of claim 1, wherein the elongated curved body has a thickness of approximately one inch, and a radius of curvature of approximately 40 inches.

8. The plow blade wear member of claim 1, wherein the attachment slots include a series of substantially horizontally aligned, off center, substantially vertically extending, spaced apart, oval attachment slots that each extend though the body from the front concave surface to the rear convex surface.

9. The plow blade wear member of claim 1, wherein the elongated curved body is strong enough to not flex or bend backward against its natural curvature when the blade wear member engages a discontinuity protruding from the travel surface at or below the designated force level.

10. The plow blade wear member of claim 1, which is formed from multiple plies of a flexible rubber material.

11. The plow blade wear member of claim 1, which is formed from multiple plies of a flexible rubber material having a reinforcing material.

12. The plow blade wear member of claim 11, wherein the reinforcing material is one of a polymer material, a polyester material, a nylon or aliphatic or semi-aromatic polyamide material, a rayon or regenerated cellulose material, and a synthetic material.

13. The plow blade wear member of claim 1, wherein the airplane tire has an outer circumference of approximately 120 inches and at least a one inch thickness.

14. A plow blade wear member comprising:

an elongated curved body formed from an airplane tire having an outer circumference of approximately 120 inches and at least a one inch thickness, said elongated curved body having:

a top edge, a bottom edge, a right side edge, a left side edge, a front concave surface, and a rear convex surface, the front concave surface having substantially the same curvature as the rear convex surface, the elongated curved body having a substantially uniform thickness from the top edge to the bottom edge, and from the right side edge to the left side edge, and said elongated curved body being flexible enough to bend backward a distance toward a rear attachment plate to which the elongated curved body is attached and against its natural curvature when the plow blade wear member engages a discontinuity protruding from a travel surface at a force level above a designated force level, and such that the backward bending of the elongated curved body the distance toward the rear attachment plate reduces a gap between the elongated curved body member and the rear attachment plate; and said elongated curved body defining a first series of attachment slots which enables the elongated curved body to be removably and adjustably attached to a blade of a blade assembly attachable to a vehicle, the attachment slots including a series of substantially horizontally aligned, off center, substantially vertically extending, spaced apart, oval attachment slots that each extend though the elongated curved body from the front concave surface to the rear convex surface.

15. The plow blade wear member of claim 14, wherein the elongated curved body includes a plurality of curved bodies.

16. The plow blade wear member of claim 14, wherein the top edge extends substantially parallel to the bottom edge, and the right side edge extends substantially parallel to the left side edge.

17. The plow blade wear member of claim 14, wherein the top edge and the bottom edge extend in intersecting planes, and the right side edge and the left side edge extend in intersecting planes.

18. A plow blade assembly attachable to a vehicle, said plow blade assembly comprising:

a blade connectable to the vehicle;

a front attachment bar;

a rear attachment plate;

a blade support;

a plurality of fasteners; and at least one curved blade wear member connected to the blade, the curved blade wear member including an elongated curved body having:

a top edge, a bottom edge, a right side edge, a left side edge, a front concave surface, and a rear convex surface, and being flexible enough to bend backward a distance toward the rear attachment plate to which the elongated curved body is attached and against its natural curvature when the plow blade wear member engages a discontinuity protruding from a travel surface at a force level above a designated force level, and such that the backward bending of the elongated curved body the distance toward the rear attachment plate reduces a gap between the elongated curved body and the rear attachment plate, said elongated curved body defining a first series of attachment slots which enables the elongated curved body to be removably and adjustably attached to the blade.

19. The plow blade assembly of claim 18, wherein the elongated curved body includes a plurality of curved bodies.

20. The plow blade assembly of claim 18, wherein the top edge extends substantially parallel to the bottom edge, the right side edge extends substantially parallel to the left side edge, and the front concave surface has substantially the same curvature as the rear convex surface.

21. The plow blade assembly of claim 18, wherein the top edge and the bottom edge extend in intersecting planes, and the right side edge and the left side edge extend in intersecting planes.

22. The plow blade assembly of claim 18, wherein the front concave surface and the rear convex surface extend toward each other at a top section or a bottom section of the elongated curved body.

23. The plow blade assembly of claim 18, wherein the elongated curved body has a substantially uniform thickness from the top edge to the bottom edge, and from the right side edge to the left side edge.

24. The plow blade assembly of claim 18, wherein the elongated curved body has a thickness of approximately one inch, and a radius of curvature of approximately 40 inches.

25. The plow blade assembly of claim 18, wherein the attachment slots include a series of substantially horizontally aligned, off center, substantially vertically extending, spaced apart, oval attachment slots that each extend though the elongated curved body from the front concave surface to the rear convex surface.

26. The plow blade assembly of claim 18, wherein the elongated curved body is strong enough to not flex or bend backward against its natural curvature when the blade wear member engages a discontinuity protruding from a travel surface at a designated force level.

27. The plow blade assembly of claim 18, wherein the elongated curved body is formed from multiple plies of a flexible rubber material.

28. The plow blade assembly of claim 18, wherein the elongated curved body is formed from multiple plies of a flexible rubber material having a reinforcing material.

29. The plow blade assembly of claim 28, wherein the reinforcing material is one of a polymer material, a polyester material, a nylon or aliphatic or semi-aromatic polyamide material, a rayon or regenerated cellulose material, and a synthetic material.

30. The plow blade assembly of claim 18, wherein the airplane tire has an outer circumference of approximately 120 inches and at least a one inch thickness.

31. A snowplow for use on a ground surface, said snowplow comprising:

a vehicle;

a plow blade assembly attachable to the vehicle, said plow blade assembly including:

a blade connectable to the vehicle;

a front attachment bar;

a rear attachment plate;

a blade support;

a plurality of fasteners; and at least one curved blade wear member connected to the plow blade, the curved blade wear member formed from an airplane tire and including an elongated curved body having:

a top edge, a bottom edge, a right side edge, a left side edge, a front concave surface, and a rear convex surface, and being flexible enough to bend backward a distance toward the rear attachment plate to which the elongated curved body is attached and against its natural curvature when the plow blade wear member engages a discontinuity protruding from a travel surface at a force level above a designated force level, and such that the backward bending of the elongated curved body the distance toward the rear attachment plate reduces a gap between the elongated curved body and the rear attachment plate, said elongated curved body defining a first series of attachment slots which enables the elongated curved body to be removably and adjustably attached to the curved blade.

32. The snowplow of claim 31, wherein the airplane tire has an outer circumference of approximately 120 inches and at least a one inch thickness.

* * * * *